United States Patent [19]

Derclaye

[11] 4,067,445

[45] Jan. 10, 1978

[54] ASSEMBLING DEVICE BETWEEN UPRIGHTS AND CROSS-MEMBERS FOR SETTING UP METAL STRUCTURES

[75] Inventor: Raymond A. Derclaye, Couillet, Belgium

[73] Assignee: Finimetal-Efel, Societe Anonyme, Frasnes-lez-Couvin, Belgium

[21] Appl. No.: 731,211

[22] Filed: Oct. 12, 1976

[30] Foreign Application Priority Data

Nov. 19, 1975 Belgium ..... 254661

[51] Int. Cl.[2] ..... A47F 5/10

[52] U.S. Cl. ..... 211/191; 248/243

[58] Field of Search ..... 211/186, 187, 189, 190, 211/191, 192, 193; 248/243; 108/106-110

[56] References Cited

U.S. PATENT DOCUMENTS

| | | | |
|---|---|---|---|
| 3,095,975 | 2/1963 | Cassel et al. | 211/192 |
| 3,900,111 | 8/1975 | Hiler et al. | 211/192 |

FOREIGN PATENT DOCUMENTS

| | | | |
|---|---|---|---|
| 921,869 | 2/1973 | Canada | 211/191 |
| 844,989 | 6/1970 | Canada | 211/192 |
| 670,899 | 9/1963 | Canada | 211/192 |
| 1,513,672 | 1/1968 | France | 211/192 |

*Primary Examiner*—Roy D. Frazier
*Assistant Examiner*—Terrell P. Lewis
*Attorney, Agent, or Firm*—Bacon & Thomas

[57] ABSTRACT

The invention pertains to an assembling device for setting up metal structures, characterized on the one hand, by the fact that the uprights are built as box-type elements having a front plane portion adjacent to two deep mouldings, which themselves are next to the side walls, to which aforesaid mouldings are connected by a semi-tubular edge, aforesaid deep mouldings being provided with spaced elongated openings, and on the other hand, by the fact that the hooking elements, which are integral with the cross-members, are provided along their height with alternate parallel and perpendicular protrusions with respect to aforesaid front face of the upright, aforesaid perpendicular protrusions fitting into aforesaid openings provided in the bottom of the deep mouldings in the upright.

1 Claim, 7 Drawing Figures

Fig. 5
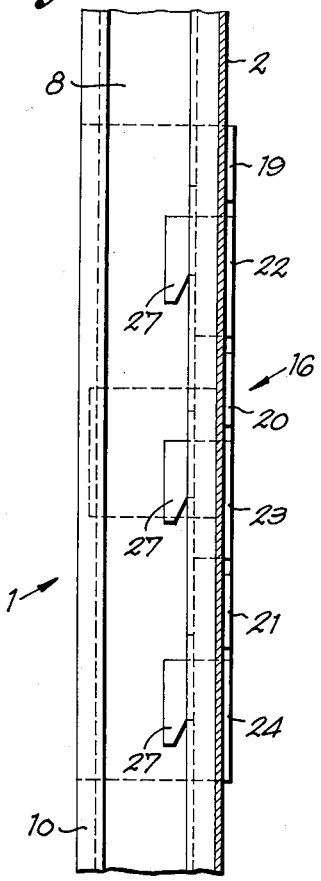
Fig. 6
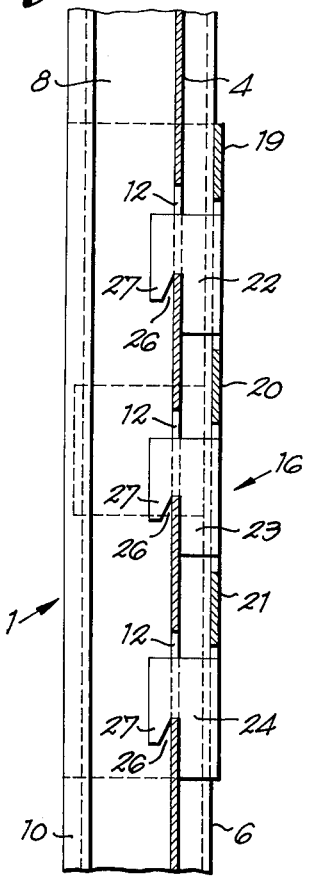
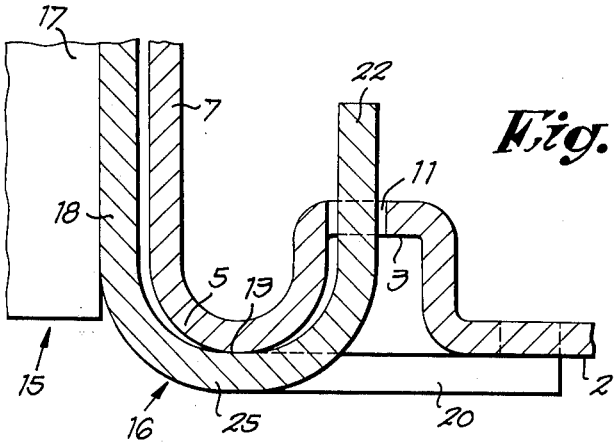
Fig. 7

ASSEMBLING DEVICE BETWEEN UPRIGHTS AND CROSS-MEMBERS FOR SETTING UP METAL STRUCTURES

This invention pertains to an assembling technique of uprights and cross-members for setting up metal structures which can be dismantled. The invention is more particularly concerned with such assembly by means of hooking elements which are integral with the cross-members. Such metal structures are intended to serve as supports for sets of shelves or for suchlike assemblies.

Aforesaid hooking elements are attached to each end of the cross-members, for instance by welding. The uprights and aforesaid hooking elements are conditioned so as to facilitate easy and fast assembly, or respectively dismantling, without in any way impairing the stability or the strength of the structures under consideration.

These results are obtained by a very particular shaping of the uprights and of the hooking elements which are integral with the cross-members. In the present case, the uprights are characterized by the fact that they consist of box-type elements which are open on the rear side and have an intermediate front flat surface which is adjacent to two deep mouldings, which are themselves close to the side walls to which aforesaid mouldings are connected by a semitubular wall, the bottom of said mouldings being provided with the spaced elongated openings. The hooking elements which are integral with the cross-members are characterized by the fact that they are provided along their height with a series of protrusions, which are alternately parallel and at right angles to the front face of aforesaid uprights, aforesaid perpendicular protrusions fitting into aforesaid openings provided in the deep mouldings of the uprights. The connection between aforesaid perpendicular protrusions and the integral wall of the cross-members is provided by a semitubular part which covers aforesaid semitubular walls of the uprights.

Aforesaid perpendicular protrusions are provided with notches in their lower edge. The height of aforesaid elongated openings in the deep mouldings of the uprights is slightly greater than the height of aforesaid perpendicular protrusions, in such a manner that besides freely entering into aforesaid elongated openings, said protrusions can also hook into same.

It is of course possible to build such metal structures to any dimension, whereby the described characteristics might be replaced by equivalent technical devices, without going beyond the scope of the present invention.

It is thus merely as an example that a form of embodiment is described hereinafter in greater detail and with reference to the appended drawings in which.

Figure 1:
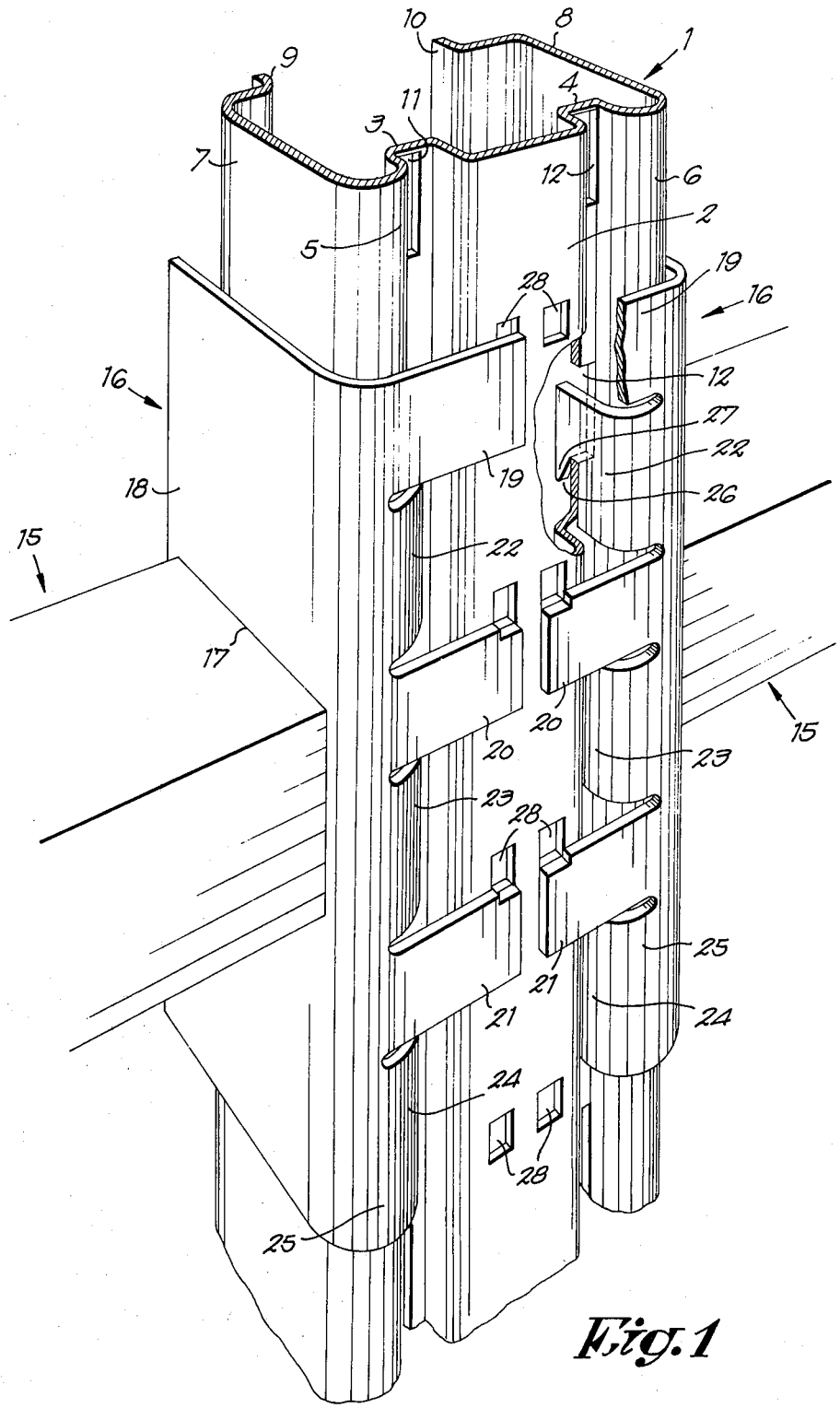
FIG. 1 is a partially cutaway perspective view of an assembled joint between cross-members and an upright.
Figure 2:
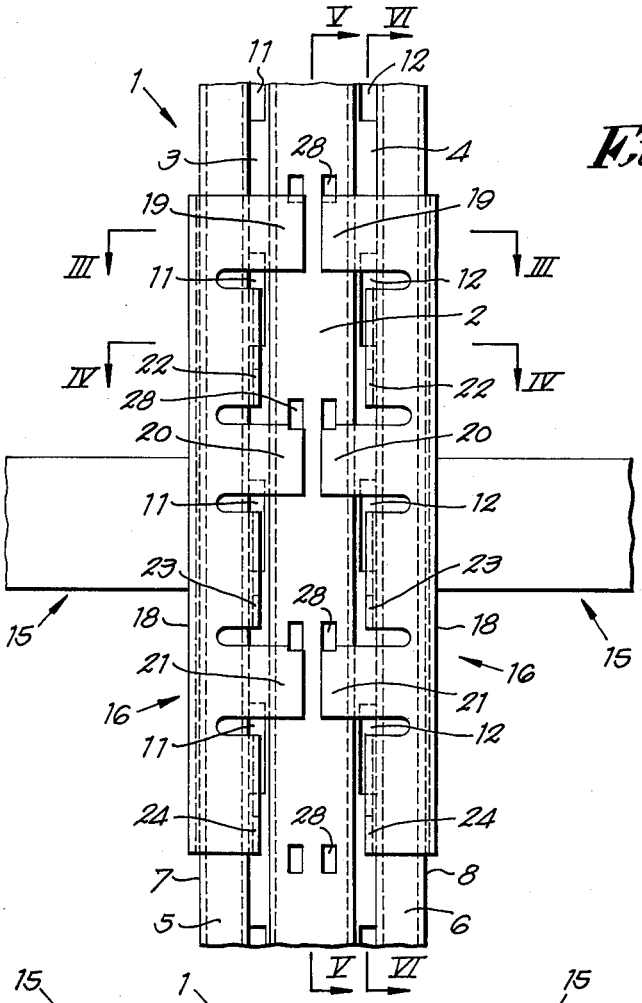
FIG. 2 is a front view of the same structure.
Figure 3:
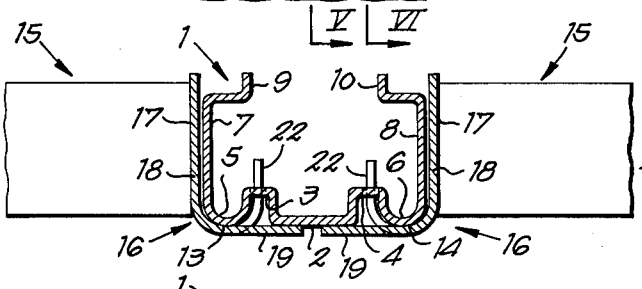
Figure 4:
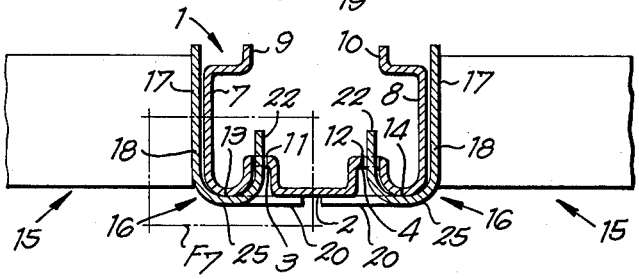

FIGS. 3 to 6 respectively are cross-sections according to lines III—III, IV—IV, V—V and VI—VI in FIG. 2;

FIG. 7 shows, to a larger scale, that part of FIG. 4 which is indicated by F7.

In this form of embodiment, the uprights 1 are built in box shape with a wide opening on the rear side and the front surface of which have an intermediate plane portion 2, two deep mouldings 3-4, two semitubular edges 5-6, two side walls 7-8 and flanged rear edges 9-10.

The bottom of aforesaid mouldings 3-4 is provided with elongated openings 11-12. Aforesaid plane portion 2 as well as the extreme generatrices, respectively 13-14, of the curved wall elements are located in one and the same front plane. The hooking-in between cross-members 15 and the upright 1 is performed by particular hooking elements 16, each of which is integral with one end 17 of a cross-member 15. Ths hooking element consists of a wall 18 of which a longitudinal edge is provided with protrusions 19-20-21 which are perpendicular to aforesaid wall 18, i.e. parallel to the central plane portion 2 of the upright, as well as with protrusions 22-23-24 which are parallel to aforesaid wall 18, i.e. perpendicular with respect to the intermediate plane portion 2 of the upright. The connection between wall 18 and aforesaid protrusions 19-20-21 consists of a semitubular wall 25. Aforesaid protrusions 22-23-24 have a height which is slightly less than the length of the elongated openings 11-12 in the bottom of the deep mouldings 3-4. On the other hand, aforesaid protrusions 22-23-24 have, along their lower edge, a notch 26 which thus forms an attaching hook 27.

In order to provide such an attachment, aforesaid protrusions 22-23-24, which are projected into aforesaid openings 11-12 of the upright, are moved slightly downward.

This assembling device is characterized by the particular shaping of the uprights and of the hooking elements which are integral with the cross-members. The uprights are of maximum rigidity, or strength, due to their conditioning and to the relative location of the deep mouldings provided with aforesaid hooking openings. The originality of this hooking device consists of the semitubular shaping of the front parts, and of the hooking elements which are integral with the cross-members and of the corresponding parts of the upright.

In fact, the superposition of the semitubular parts, respectively of the upright and of the cross-members, assures a better covering and a self-tightening of the cross-members.

Subsidiarily, the uprights are provided in their front plane portion with two rows of openings 28, of which the lower edge registers with the upper edge of protrusions 19-20-21, so that a key can be fitted in the openings 28, thus in a way locking the upright to cross-member connection. This provides for an extra safety to prevent the cross-members from getting detached from the uprights, in the case for instance of shocks.

The invention just as well concerns the assembling device as a whole, as the individual constituent elements thereof.

What we claim is:

1. In a metal structure having a plurality of upright post members and cross members extending between said post members, the improvement comprising:

said post members each having spaced parallel side walls curved inwardly at their forward edges to define semi-tubular front portions, then reversely bent to define channels adjacent said semi-tubular portions and a central planar front face between said channels;

a pair of vertical rows of first openings in said front face;

a vertical row of second openings in the bottom of each of said channels;

said cross members each having an end plate perpendicular thereto abutting a side wall of a post and having alternating portions extending across an adjacent channel into abutment with said front face with intermediate portions bent to closely embrace the adjacent semi-tubular portion and extend into said adjacent channel;

each of said intermediate portions having a downwardly hooked inner edge engaged in one of said second openings; and said portions extending across said adjacent channel having upper edges generally coincident with lower edges of first openings of one of said rows.

* * * * *